US005344015A

United States Patent [19]

Carlin et al.

[11] Patent Number: 5,344,015

[45] Date of Patent: Sep. 6, 1994

[54] CARDHOLDER AND CARRYING CASE THEREFOR

[75] Inventors: Ira W. Carlin, Thornhill; Morris Fischtein, Downsview, both of Canada

[73] Assignee: Pro-Index Corp., Concord, Canada

[21] Appl. No.: 946,892

[22] Filed: Sep. 18, 1992

[30] Foreign Application Priority Data

Feb. 28, 1992 [CA] Canada ..... 2062055

[51] Int. Cl.[5] ..... B65D 85/48

[52] U.S. Cl. ..... 206/449; 206/425; 206/564

[58] Field of Search ..... 206/38, 449, 454, 425, 206/387, 444, 564; 220/532, 533

[56] References Cited

U.S. PATENT DOCUMENTS 4,212,401 7/1980 Schweizer ..... 206/425
4,640,416 2/1987 Northrup et al. ..... 206/425
4,848,574 7/1989 Murphy et al. ..... 206/425
4,979,619 12/1990 Hager ..... 206/45.34
5,027,950 9/1991 Gutierrez et al. ..... 206/425

FOREIGN PATENT DOCUMENTS 614981 12/1948 France ..... 220/533

*Primary Examiner*—David T. Fidei
*Attorney, Agent, or Firm*—Riches, McKenzie & Herbert

[57] ABSTRACT

In combination, a polystyrene holder for baseball cards, stamps and the like comprising two planar-shaped members adapted to receive each other in snap-fit engagement to provide the holder with an inner space for retaining the card and a case for storing and transporting the holders. The case is formed of polypropylene having a base with a double row of a plurality of semi-cylindrical recesses in single-file arrangements to receive a plurality of holders in a single-file arrangement. The card holders and case provide convenient, light-weight, light-resistant systems for the quick viewing, storage and retention of the cards.

4 Claims, 11 Drawing Sheets

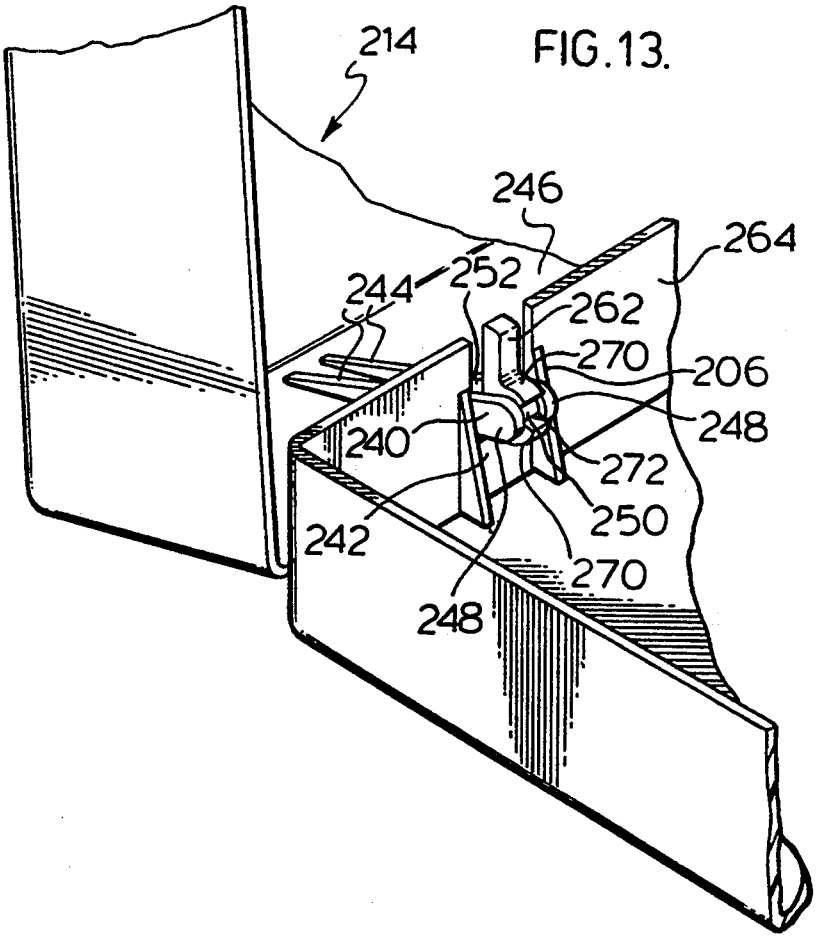
FIG.13.
FIG.14.
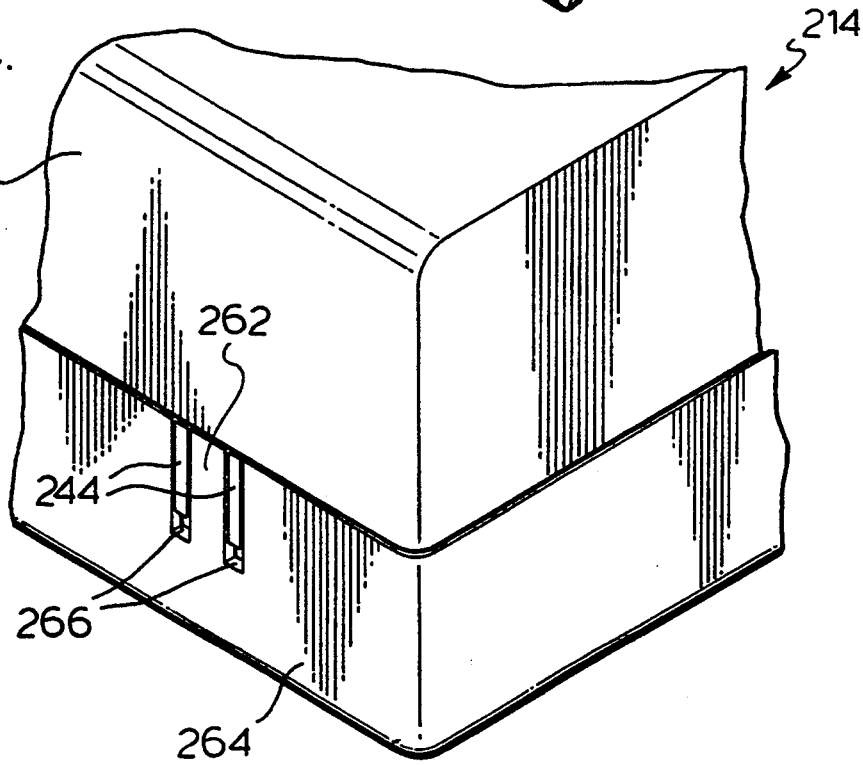

CARDHOLDER AND CARRYING CASE THEREFOR

FIELD OF THE INVENTION

This invention relates to holders for display exhibits such as celebrity cards, postage stamps and the like; and to cases for storage and manual carrying of said holders.

BACKGROUND OF THE INVENTION

In view of the popularity of collecting display exhibit cards such as celebrity sports cards, particularly those of baseball celebrities, and the increasing financial value of such cards, it is most important that suitable means be found for protecting these exhibits during storage and transportation.

To-date, these cards are either stored in simple boxes, with or without individual protective coverage, such as provided by individual plastic pouches, or other unsatisfactory, but, handleable storage cases.

Generally, known storage boxes are poorly adapted to store exhibit cards over long periods of time and are often not designed to enable the cards to be stored upright or prevent the sliding movement of cards, both of which may lead to the cards being damaged. Further, known card storage boxes which are adapted specifically to store sports cards are often expensive and are frequently not sized or suitably shaped to hold more than one complete set of cards.

It is an object of the present invention to provide a holder for the storage of an individual celebrity card, postage stamp and the like which case provides a convenient, superior and advantageous storage environment.

It is a further object of the present invention to provide a holder case for the storage and transportation of a plurality of such holders, which provides a superior and convenient case for the storage and transportation of such holders in an upright position.

It is a yet further object of the invention to provide a case and holder combination which provides for the convenient viewing of the exhibit cards in the holders within the case without removal therefrom.

These and other objects will be apparent to those skilled in the art from the present specification when taken in conjunction with the appended drawings.

SUMMARY OF THE INVENTION

The present invention, in one aspect, provides a planar-shaped holder formed of a thermoplastics material for the retention of a planar-shaped exhibit such as a celebrity card, postage stamp and the like; which holder comprises a first planar-shaped member and a complementary opposing second planar-shaped member adapted to receive each other in snap-fit engagement by means of snap-fit engaging means to provide said holder with an inner space adapted to retain said exhibit.

Preferably, the thermoplastic material is a crystal polystyrene, suitably U.V. stabilized to prevent deterioration of the polystyrene and fading of the colours of the exhibit. More preferably, the holder has a clear crystal polystyrene window through which the card is viewed while the edges of the holder may be frosted to enhance the card presentation, hide grooves, inner linings and wear marks. Yet more preferably, the card holder is formed of crystal polystyrene having minimal amounts of free styrene monomer, in order to reduce the risk of interaction between the inks used in the production of the exhibit cards and styrene.

In a preferred embodiment, the snap-fit engaging means comprises an upstanding member on one or both of the first and second members adapted to be received by an upstanding member receiving-recess on the other or both of the first and second members in complementary opposing engagement to provide an air-tight inner space to prevent oxidation of the exhibit card. While the two opposing members may be disengaged manually to allow opening of the holder when desired, such an advantageous locking mechanism caused by the frictional engagement of the resiliently flexible members will not easily allow opening of the holder if it is accidently dropped.

Preferably the snap-fit engaging means comprises either or both of said first and second members having an upstanding member and/or a complementary opposing upstanding member receiving-recess perpendicular to the plane of said holder, which upstanding member and opposing recess operably engage each other.

In a more preferred aspect the snap-fit engaging means comprises said first member having a continuous upstanding member, perpendicular to the plane of and substantially around and adjacent to the periphery of said first member; said second member having a continuous recess substantially around and adjacent the periphery thereof and adapted to receive said upstanding member in snap-fit engagement.

Alternatively, the snap-fit engaging means comprises each of said first and second members having a continuous upstanding member substantially adjacent to and around one half of the periphery of said member and a continuous recess around the remaining half of its periphery in complementary opposing relationship to said upstanding member of other member; wherein said recesses operably receive said upstanding members in snap-fit engagement.

In yet an alternative aspect the snap-fit engaging means comprises each of said first and second members having a plurality of upstanding members and recesses intermittent around and adjacent the peripheries thereof in complementary opposing relationship such that said recesses operably receive said upstanding members in snap-fit engagement.

In a still yet alternative aspect the snap-fit engaging means comprises a plurality of upstanding pins on either or both of said first and second members and complementary opposing recesses on either or both of said first and second members, which recesses operably receive said pins in snap-fit engagement.

In each of the aspects defined hereinabove, preferably the snap-fit engaging means is optionally releasable by the prising apart of the members to disengage the snap-fit engaging means.

The holders according to the invention as hereinabove defined may further comprise hinge means at one end thereof by which said first and said second members are hinged one to the other and preferably wherein said hinge means comprises each of said first and second members having a plurality of resiliently flexible protrusions and recesses along an edge thereof and wherein said protrusions are in complementary engagement within opposing said recesses.

Holders according to the invention preferably have a surface portion at a periphery thereof adapted to be received by and operably rotatable within a holding recess of a storage container.

The surface portion is, preferably, elliptically-shaped or cylindrically shaped and, more preferably, is constituted by an elliptically -or cylindrically shaped member. Yet more preferably, the holder has a pair of such elliptically -or cylindrically shaped members disposed one from the other at an edge of the holder. The elliptically -or cylindrically shaped member may be constituted by a pair of opposing hemi-elliptically shaped or hemi-cylindrically shaped members, one hemi-elliptically shaped or hemi-cylindrically shaped member being integrally formed with the first planar-shaped member and another hemi-elliptically shaped or hemi-cylindrically shaped member with the complementary opposing second planar-shaped member.

By the term "elliptically-shaped member" is meant an elongated member being substantially elliptically-shaped when viewed along its axis. An elliptically shaped surface portion is a portion of a member which defines a substantially elliptical surface as hereinabove defined.

By the term "cylindrically shaped member" is meant an elongated member being substantially cylindrically-shaped when viewed along its axis. A cylindrically shaped surface portion is a portion of a member which defines a substantially cylindrical surface as hereinabove defined.

The inner space of the holder is so suitably shaped as to conveniently retain the object exhibit card in an intimate manner to prevent the corners of the slim profiled object to be broken or creased.

The individual members comprising the holder can be readily manufactured by extrusion techniques well-known in the art, and, preferably, are identical in shape to provide minimal capital tooling costs.

In a further aspect, the invention provides a card holder case for the storage and transportation of a plurality of card holders as hereinabove defined.

Accordingly, in a further aspect the invention provides a case for the storage and carrying of a plurality of holders as hereinabove defined, said case comprising a base adapted to receive a plurality of said holders, individually, in a plurality of individual holder-retaining means in a single-file arrangement.

Preferably, each of said individual holder retaining means comprises a resiliently flexible material defining a recess adapted to receive said holder.

More preferably, each of said individual holder retaining means comprises a pair of partially cylindrical recesses disposed one from the other so as to provide said base with a double row, in parallel, of a plurality of said partially cylindrical recesses in single-file arrangements and adapted to receive and retain said plurality of holders in a single-file arrangement.

By the term "partially cylindrical recess" is meant a substantially circular, when viewed along its axis recess providing an opening of less than 180°. The opening is of sufficient width to allow entry of an edge of the holder into the recess under the resilient flexibility of the edges of the recess.

Thus, the resilient flexibility of the material defining the partially cylindrical recess having less than a 180° opening allows the edge of the holder to enter the recess under a suitable manual pressure and be rotatably retained therein.

The above objective is conveniently achieved where the holder has a cylindrical-shaped member retained within the partially cylindrical recess described hereinabove.

Clearly, other suitable shapes of holder-retaining recesses and holders retainable therein may be contemplated without departing from the spirit and intent of the invention.

However, we have surprisingly found that disposition of holders as hereinabove defined having an elliptically-shaped member with the longer axis of the ellipse coplanar of the holder within the partially cylindrical recess being of such diameter as to permit-only partial rotation of the elliptically shaped member in the recess provides significant advantages. The elliptically-shaped member and recess maybe so shaped and of such dimensions as to permit of a desired maximum deviation of the holder either side of the vertical plane of the holder when it is retained within the holder-retaining recess. Such maximum deviation is, typically, about 45° either side of the vertical plane of the holder, but other maximum angular deviations maybe selected. Such a retaining arrangement allows individual holders to be so angled from the vertical relative to its neighbor holders to be conveniently viewed when part of a plurality collection without removal of that holder from the case. Such flexibility provided to the card collection provides very significant display convenience.

Further, such an arrangement allows of the orderly retention of the card holders within the case whether or not the upper edges of the card holders abut the upper inside surface of the case cover.

The case is generally formed of a lightweight, scratch resistant and durable polypropylene. We have found that the physical properties of polypropylene provides performance advantages, such as toughness, good processibility and superior stress crack resistance to produce a wide array of moulded cases according to the invention. We have found that the easy flow of polypropylene during processing minimizes moulded-in stress, resulting in drop-weight impact resistance most suitable for use as a case according to the invention. Furthermore, we have found that polypropylene provides the case with very good dimensional stability and warp resistance, due to uniform shrinkage patterns, over a wide range of environmental conditions. The polypropylene preferably comprises 2% carbon black to impart partial U.V. stability.

The case is provided with clear windows, for viewing of the holders retained therein, formed of a crystal polystyrene containing U.V. light stabilizers.

In a further feature the invention comprises a case as hereinabove defined further comprising a lower wall; a cover comprising an upper wall; hinge means connecting said lower wall to said upper wall to allow of opening of said case; releasable closing engagement means to effect closing of said case; wherein said hinge means comprises an upper hinge member integrally formed with said upper wall and a lower hinge member integrally formed with said lower wall; said upper hinge member comprising a pair of parallel, elongated arms extending from said upper wall, which arms terminate adjacent their ends remote from said upper wall with an connecting axle; wherein said arms, said upper wall and said axle define an elongated aperture; said lower hinge member comprising an elongated upstanding member coplanar and integrally formed with said lower wall; and said upstanding member has a pair of resiliently flexible protrusions which protrusions with said upstanding member define an axle receiving aperture; and wherein said upstanding member and said lower rear wall define a pair of vertical slots which, operably, individually receive said arms in coplanar arrangement when said case is in a closed position with said cover in engagement with said base.

The case according to the invention holds a plurality, typically numbering from 20 to 150, of card holders in single-file arrangement, in either a sole single-file arrangement or a multiplicity, typically numbering 2 to 5 lines or rows of parallel, single-file arrangements. The case may be used as a permanent storage box made into various sizes for the indexing of card holders. The indexing system could be flexed in a round, half-round, and alternative shapes to hold card holders of various shapes.

The card holders are thus retained within the storage case as hereinabove described in an optional, easy snap-in/out system.

In a further aspect, the invention provides in combination, a plurality of planar-shaped holders as hereinbefore defined for exhibit cards and the like, and a case for the storage and carrying of said holders as hereinbefore defined.

In a preferred combination, the invention provides a plurality of holders and a case therefor, said case comprising: a base having a plurality of holder-retaining means adapted to receive a plurality of said holders in single-file arrangement; each of said holder-retaining means comprises a pair of partially cylindrical recesses disposed one from the other so as to provide said base with a double line of a plurality of recesses in single file arrangement; said holder comprising: a first rectangular planar-shaped member and a complementary opposing second rectangular planar-shaped member, said members adapted to receive each other in snap-fit engagement by means of snap-fit engaging means to provide said holder with an inner space adapted to retain a rectangular planar-shaped object; wherein said snap-fit engaging means comprises either or both of said first and second members having an upstanding member and/or a complementary opposing upstanding member-recess perpendicular to the plane of said holder, which upstanding member and opposing recess operably engage each other in releasable engagement; a pair of retainable members disposed are from the other at an edge of said holder; wherein said recesses receive said retainable members of said holders within said case in single-file arrangement of said holders.

Preferably, each of the retainable members is constituted by the abutment of a pair of integrally-formed substantially hemi-cylindrical, or more preferably, hemi-elliptical, members on each of said first planar-shaped member and said complementary opposing second planar-shaped member.

BRIEF DESCRIPTION OF THE DRAWINGS

In order that the invention may be better understood, preferred embodiments will now be described by way of example only, wherein:

FIG. 13 is a diagramatic perspective view of a preferred hinge means of a case according to the invention, in an open position; and FIG. 14 is a diagramatic perspective view of a preferred hinge means of a case according to the invention, in a closed position.

DETAILED DESCRIPTION OF THE DRAWINGS

Figure 1:
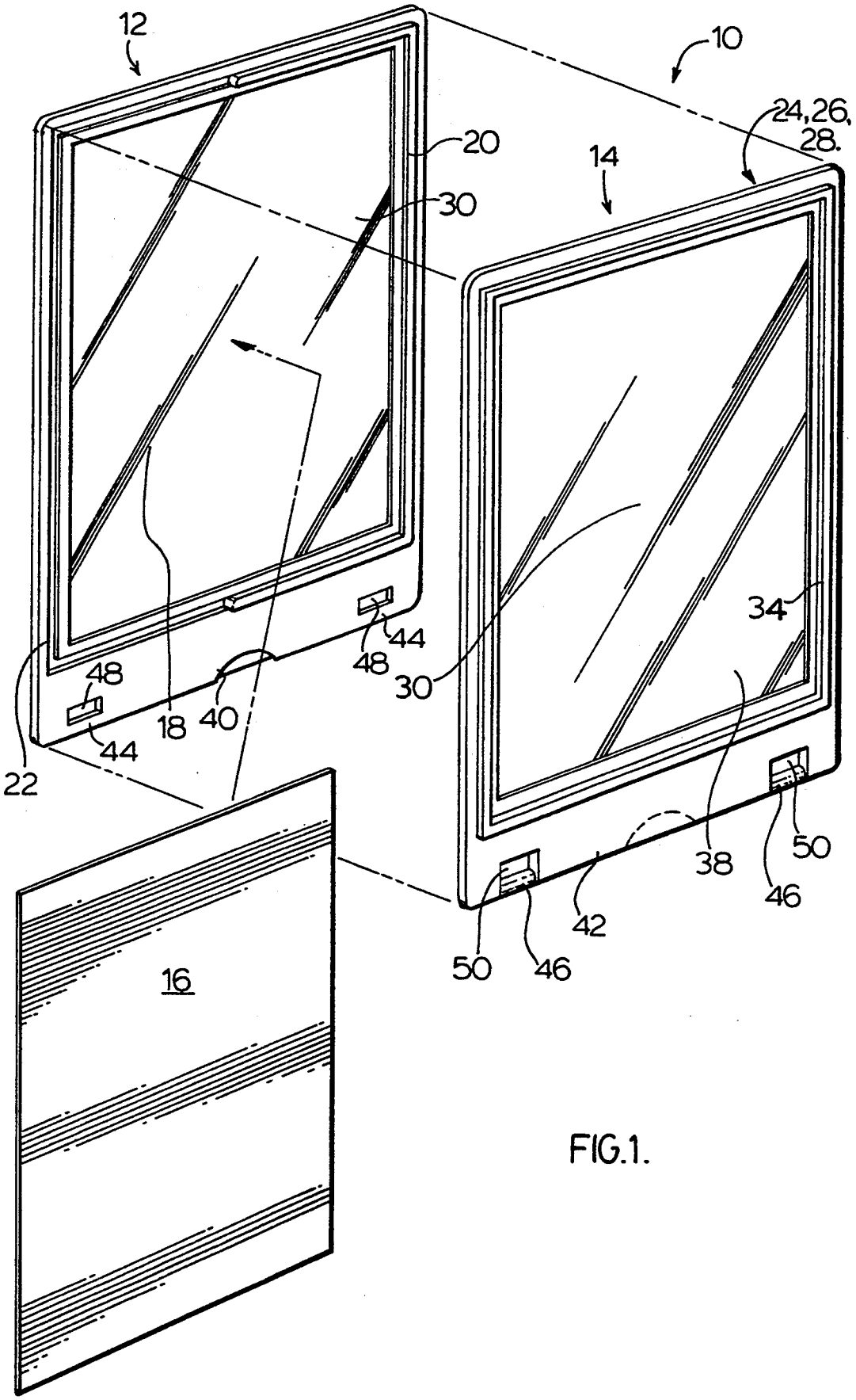
FIG. 1 is a diagramatic perspective view of two halves of a preferred holder according to the invention and a display card therefor.
Figure 2:
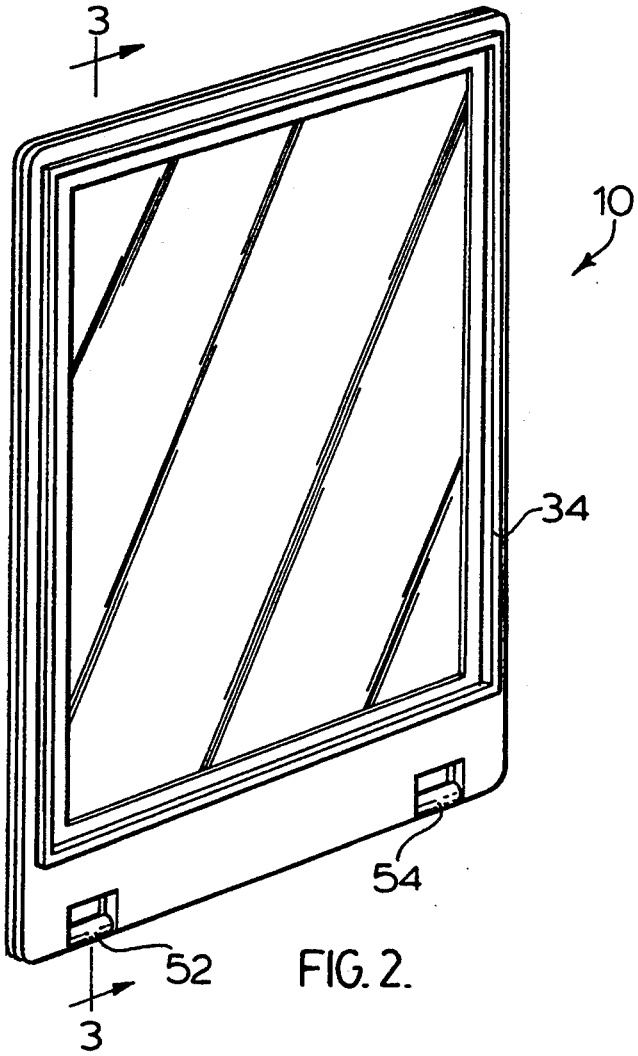
FIG. 2 is a diagramatic perspective view of the holder of FIG. 1 after assembly.
Figure 3:
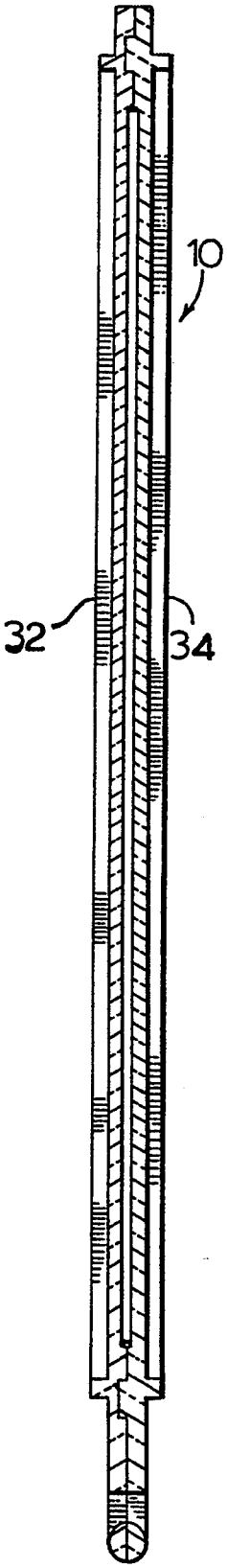
FIG. 3 is a side elevation in section of the holder of FIG. 2.

FIGS. 1, 2 and 3 show a rectangular planar-shaped holder 10, having a first planar-shaped rectangular member 12 and a second planar-shaped rectangular member 14; with a rectangular baseball card 16.

Members 12, 14 are formed of a crystal polystyrene containing a U.V. light stabilizer (Tinuvin 770*) and U.V. light stabilizer (Tinuvin P*), for protection of the crystal polystyrene and to minimize fading of exhibit card 16.

* Trade-mark of CIBY-GEIGY.

In the embodiment shown, holder 10 has a maximum thickness of approximately 3.5 mm to confer a slim profile with a minimum bulkiness, to provide a lightweight, strong and handleable holder.

Member 12, on one face 18 thereof, has an integrally-formed upstanding member 20, perpendicular to the plane of face 18, adjacent to and continuous around the periphery of one half of member 12; and a continuous recess 22, adjacent to and around the remaining half of member 12 on face 18. In a similar manner, member 14 has on one face 24 thereof (not shown), a continuous upstanding member 26 (not shown) and continuous recess 28 (not shown) in complementary opposing relationship to upstanding member 20 and recess 22 of member 12, when faces 18 and 24 oppose each other. Member 20 is operably received by recess 28 and member 26 by recess 22 in frictional retaining engagement. The dimensions and resilient flexibility of members 20 and 26 and corresponding recesses 22 and 28 are such as to provide an air-tight, releasable snap-fit engagement of members 12, 14.

Upstanding members 20, 26 are also of such dimensions as to provide holder 10, when assembled, with an inner space to intimately receive exhibit card 16 such that the latter will not move around when holder 10 is closed and also to prevent the corners of card 16 from creasing or breaking off. Further, the air-tight snap-fit engagement of members 12, 14 reduces the risk of card 16 deteriorating by oxidation. The snap-fit arrangement further advantageously prevents holder 10 from accidently opening, for example, if dropped. Yet on the other hand, the holder may be readily opened by manually prising members 12, 14 apart, against the resilience of members 20, 26 in recesses 22, 28. It will be readily appreciated that the dimensions of holder 10 in alternative embodiments may be selected to be appropriate for the size and shape of exhibit 16 to be retained.

Each of members 12, 14 has a clear window 30 through which the exhibit baseball card can be viewed directly.

Around the periphery of windows 30, each of members 12, 14 has a raised portion 32, 34 on faces 36,38, respectively, remote from faces 18, 24, respectively. Raised portions 32, 34 reduce the risk of scratching and the like of clear windows 30.

Each of members 12, 14 at an edge 40, 42, thereof, respectively, has a pair of integrally-formed hemi-elliptical portions 44, 46, respectively, disposed one from the other along edges 40, 42, respectively. Members 12, 14 are each provided, also, with a pair of indexing apertures 48, 50, respectively, adjacent edges 40, 42 respectively- With particular reference to FIG. 2, hemi-elliptical members 44, 46 upon assembly of holder 10, combine with their counterparts to form full elliptically-shaped members 52, 54.

Figures 1A, 1B:
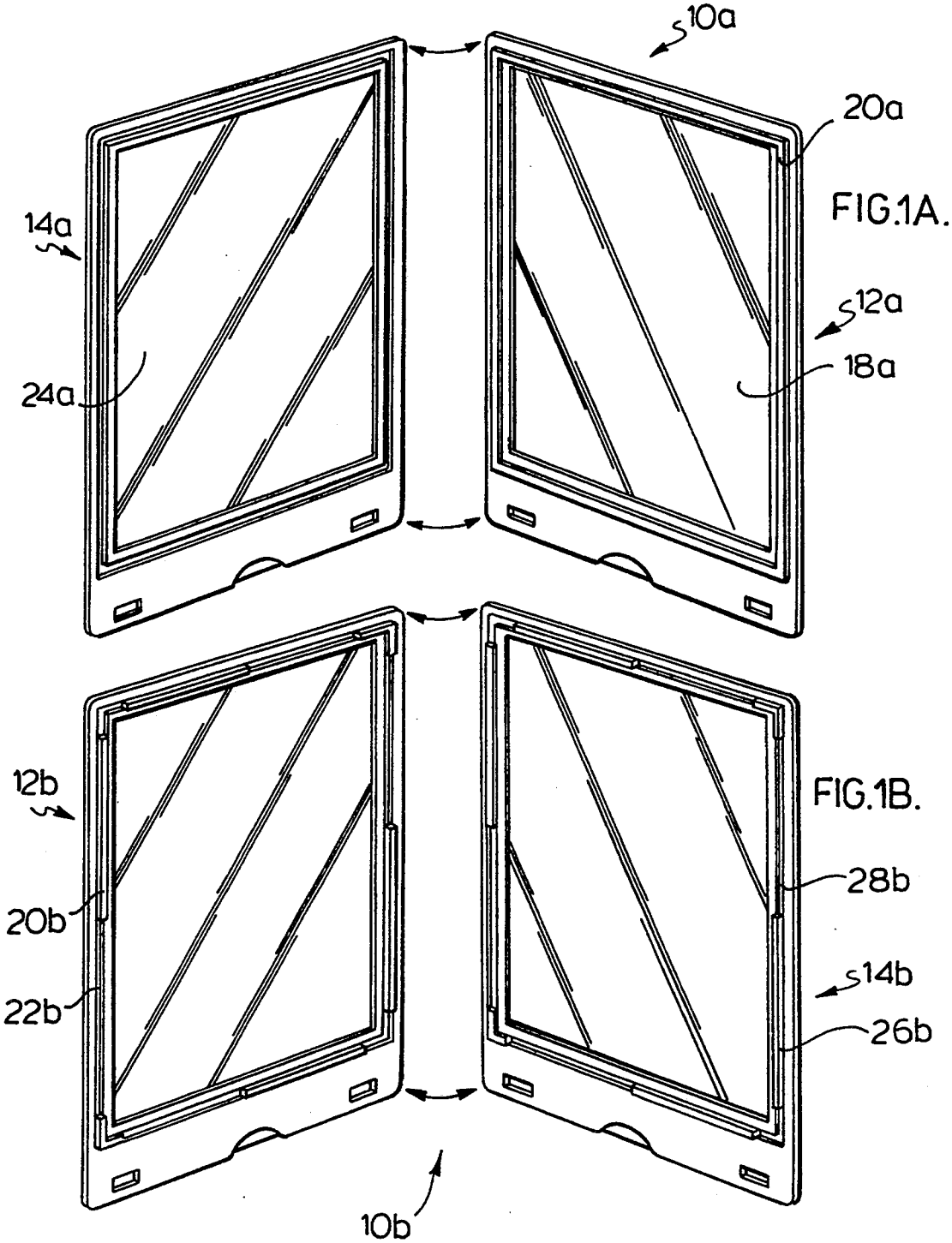
FIG. 1A and FIG. 1B are diagramatic perspective views of two halves of alternative holders according to the invention.

In an alternative embodiment, shown in FIG. 1A upstanding member 20*a* of holder 10*a* may extend perpendicularly to the plane of member 12*a* continuously around and adjacent to the full periphery on face 18*a*, to be received by opposing recess 28*a* which extends continuously around and adjacent the full periphery of face 24*a* of member 14*a*.

In a further alternative embodiment, shown in FIG. 1B upstanding members 20*b*, 26*b* comprise a plurality of individual, relatively small, upstanding members intermittent around and adjacent the peripheries of both members 12*b*, 14*b*, and a plurality of recesses 22*b*, 28*b* intermittent around and adjacent the peripheries of both members 12*b*, 14*b*, in suitable opposing relationship for recesses 22*b*, 28*b* to operably receive upstanding members 26*b*, 20*b*, respectively, in snap-fit engagement.

In yet a further alternative embodiment (not shown), either or both of members 12, 14 has a single or plurality of upstanding pins and/or complementary opposing recesses, which recesses operably receive the pins in releasable snap-fit engagement in consequence of the resilient flexibility of the thermoplastic pins.

Figure 9:
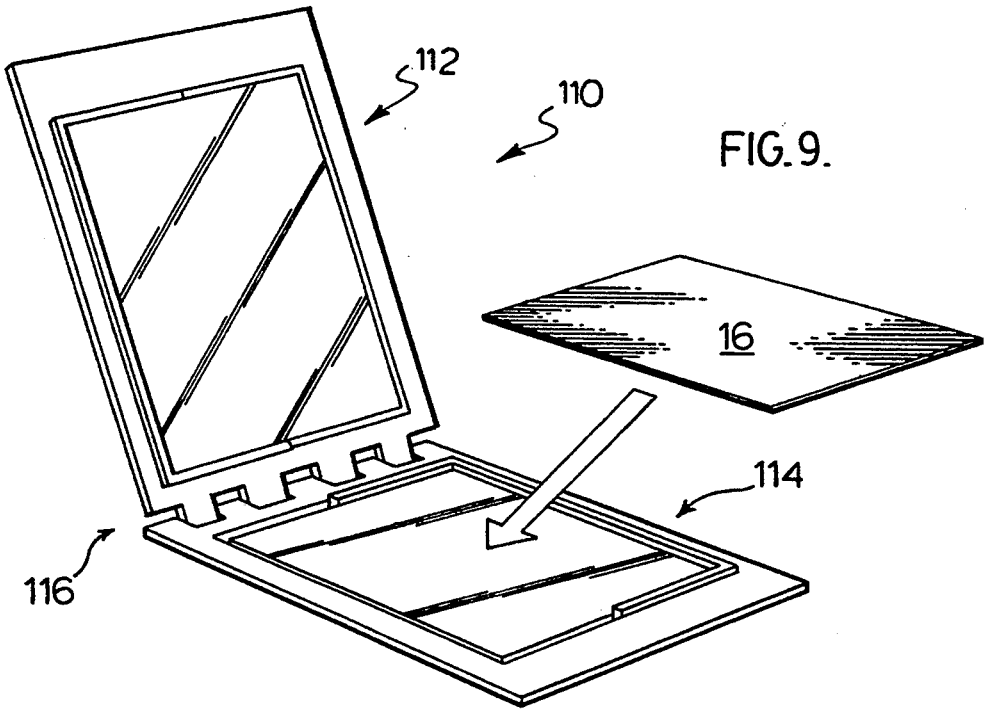
FIG. 9 is a diagramatic perspective view of an alternative holder according to the invention provided with a hinge and an exhibit therefore.
Figure 10:
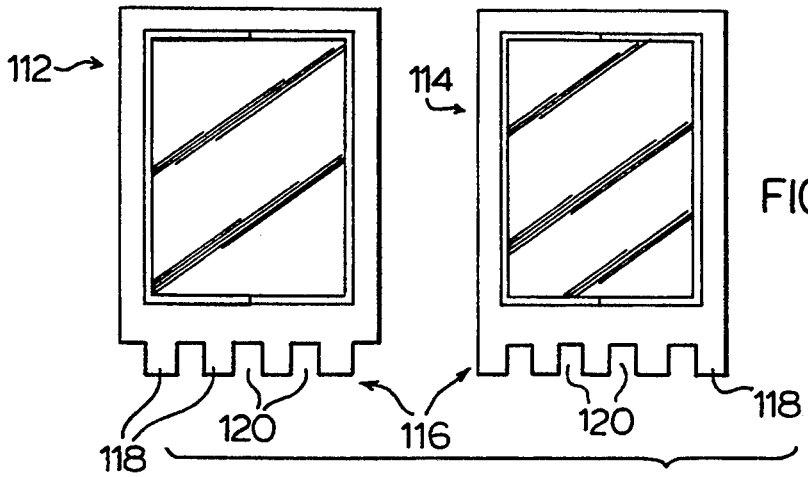
FIG. 10 is a diagramatic planar view of two halves of the holder of FIG. 9, unassembled.

FIGS. 9 and 10 show two halves 112, 114 of an alternative embodiment of a holder 110 provided with hinge means shown generally as 116. Each of members 112, 114 at an end thereof has a plurality of resiliently flexible co-planar protrusions 118 and recesses 120, operably in With particular reference to FIGS. 5A and 5B, members 52, 54 are retained within recesses 222 in snap-fit, but rotatable and releasable engagement. Each of members 52, 54 has its longer axis, shown as "y", coplanar with holder 10 and of greater length than the cross-sectional diameter of recess 222. The shorter axis, shown as "x", is of such suitable width as to allow member 52, 54 to be received and retained within recess 222 by utilizing the resilient flexibility of the upper sides 211 partially defining recess 222. Rotation of member 52, 54 within recess 222 is possible only until the cross-sectional width as received within recess 222 increases to the point that further rotation within the recess is not possible. Selection of appropriate relative sizes of recess 222 and member 52, 54 can give selected, desired degrees of rotation from the vertical axis, i.e. perpendicular to base 210, within the case of holder 10. Clearly, in the alternative embodiment diagramatically shown in FIG. 5 where the widths of member 52, 54 along the "x" and "y" axis are equal, i.e. member 52, 54 is cylindrical, rotation of the member 52, 54 within recess 222 is unimpeded until holder 10 is substantially horizontal within the case and parallel to base 210.

Figure 6:
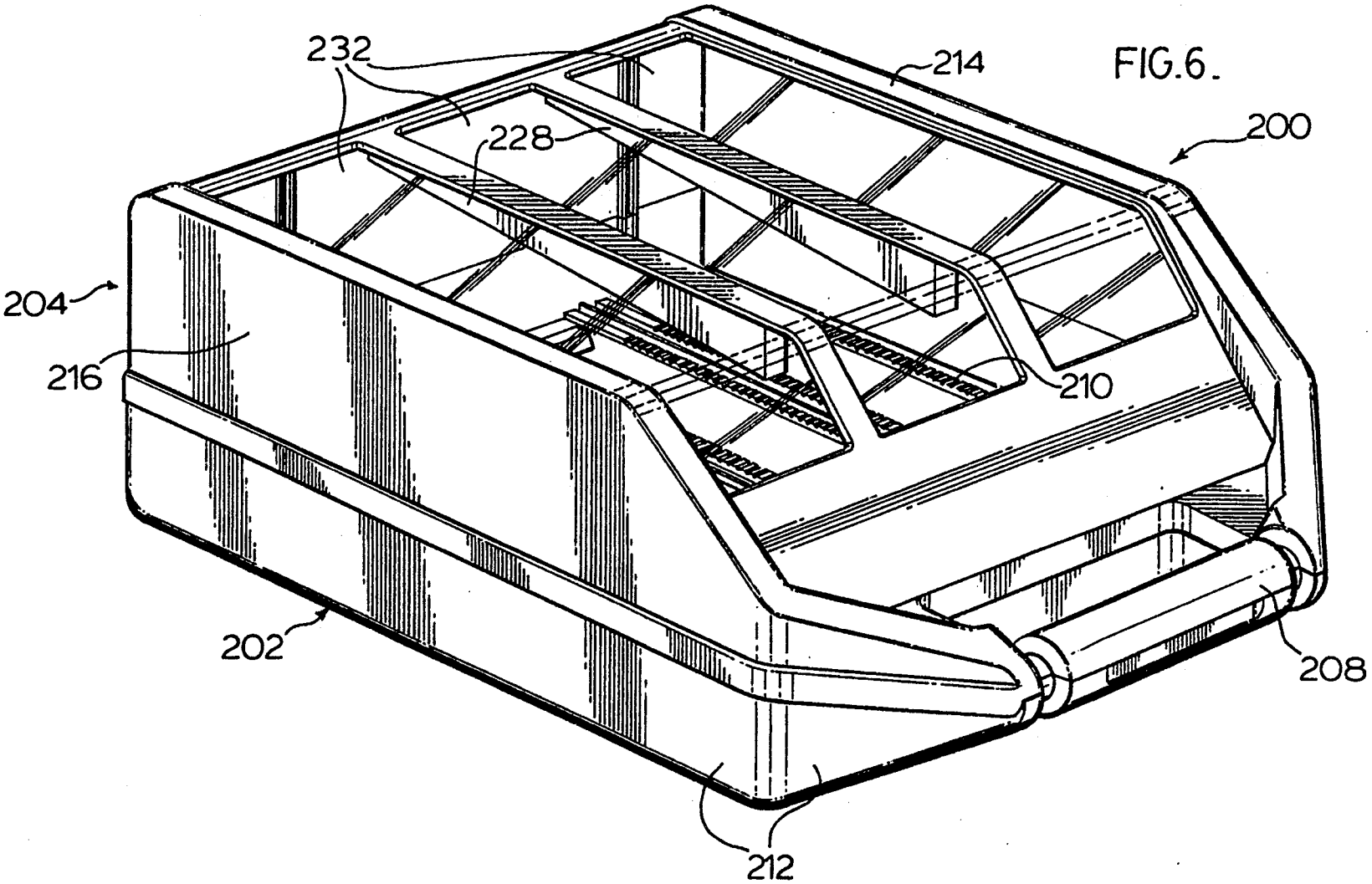
FIG. 6 is a diagramatic perspective view of a preferred case according to the invention in a closed position.
Figure 7:
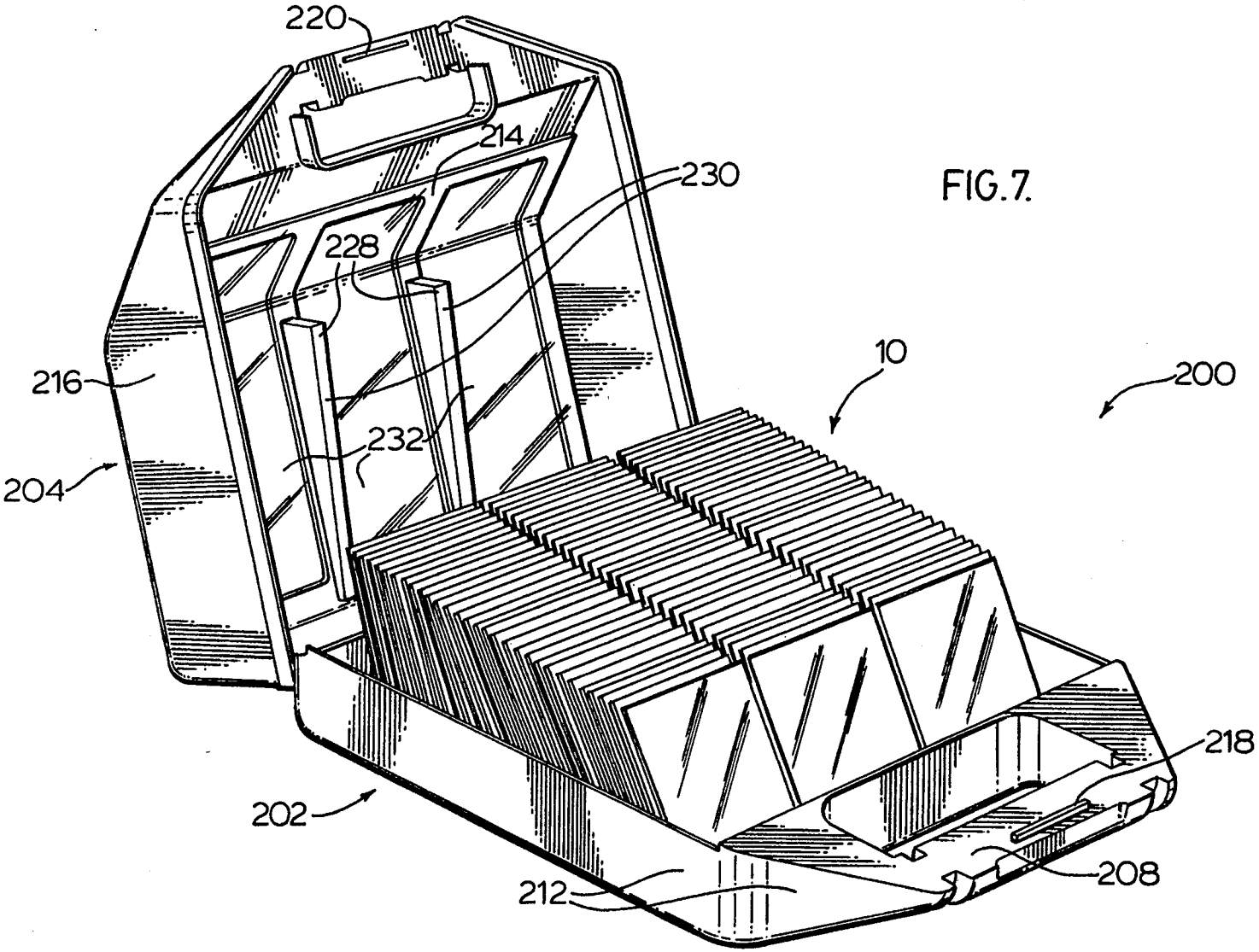
FIG. 7 is a diagramatic perspective view of the case of FIG. 6 in an open position and holding a plurality of holders according to the invention.
Figure 8:
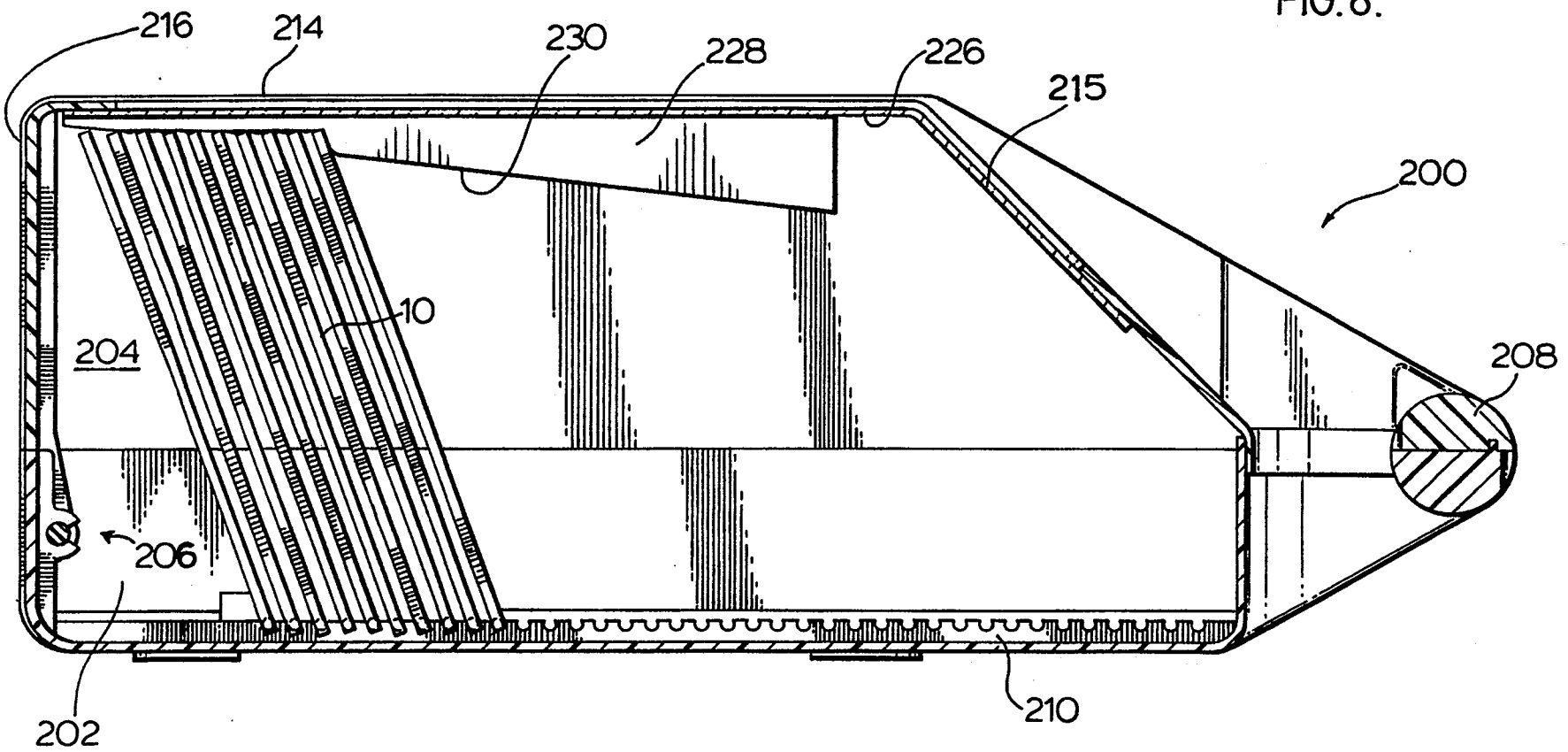
FIG. 8 is a diagramatic side elevation of a case according to the invention in section and a plurality of holders according to the invention.

With reference to FIGS. 6–8, top member 214 of case 200, on its inner side 226, has a pair of upstanding, wedge-shaped retaining members 228, central and tapering lengthwise of top member 214 such that the thick edge of complementary engagement such that protrusions 118 reside within opposing recesses 120.

FIGS. 6–8 show, generally as 200, a case, formed of a lightweight, durable polypropylene material, having a lower part, shown generally as 202, an upper part, shown generally as a cover 204, hinged thereto by hinge, shown generally as 206 and a carrying handle 208.

Lower part 202 has a base 210 and lower walls 212. Upper part 204 has a cover 214 and upper walls 216. Case 200 has a releasable closing engagement means constituted by resiliently flexible engagement snap-fit member 218, in lower part of handle 208, and co-operably resiliently flexible receivable member 220 in upper part of handle 208, in frictional engagement therewith.

Figure 4:
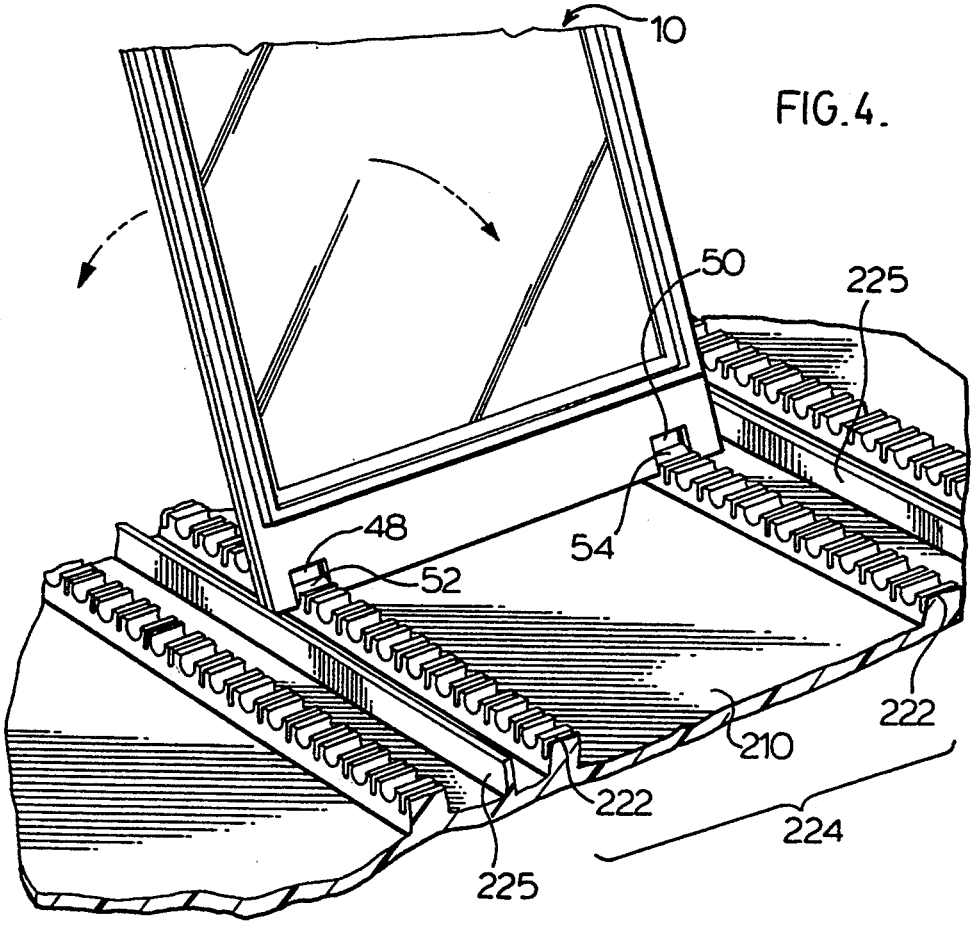
FIG. 4 is a diagramatic perspective view of a section of the holder of FIG. 2 and a base of a preferred case according to the invention.
Figure 5:
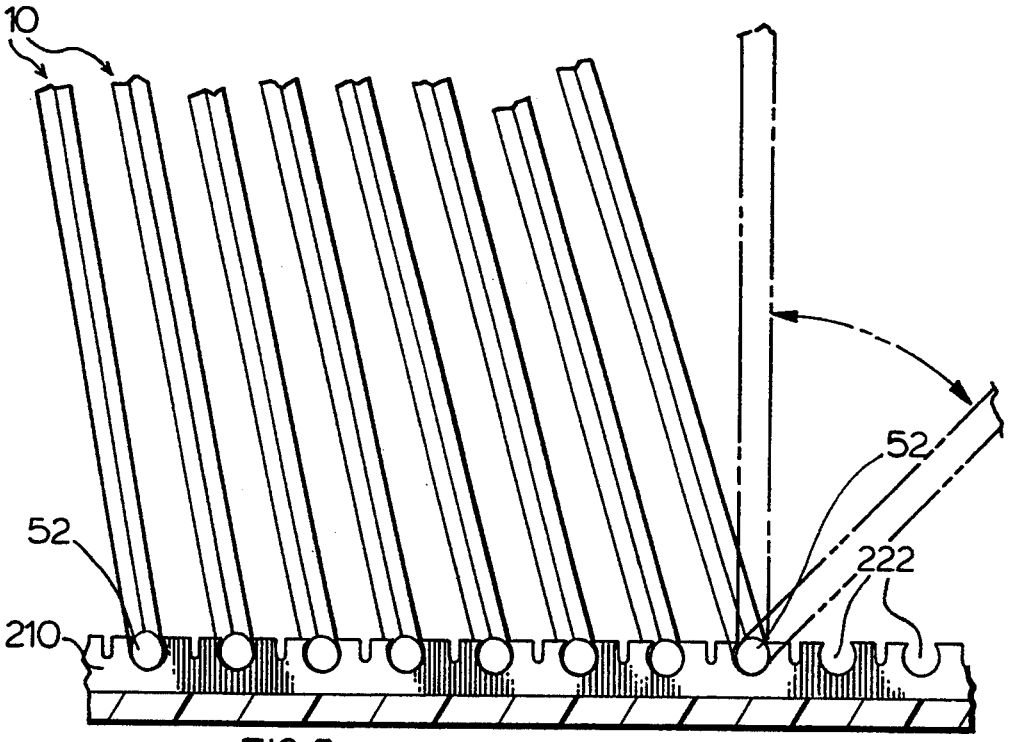
FIG. 5 is a diagramatic side elevation of a plurality of holders according to the invention in a base of a case according to the invention.
Figure 5A:
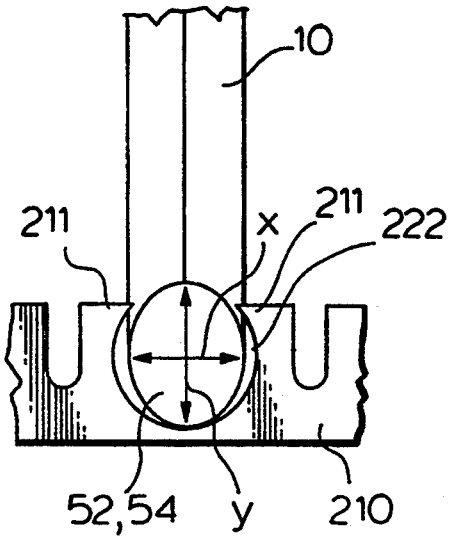
FIG. 5A and FIG. 5B are enlarged diagramatic side elevations of a section of a holder and base of a case according to the invention.
Figure 5B:
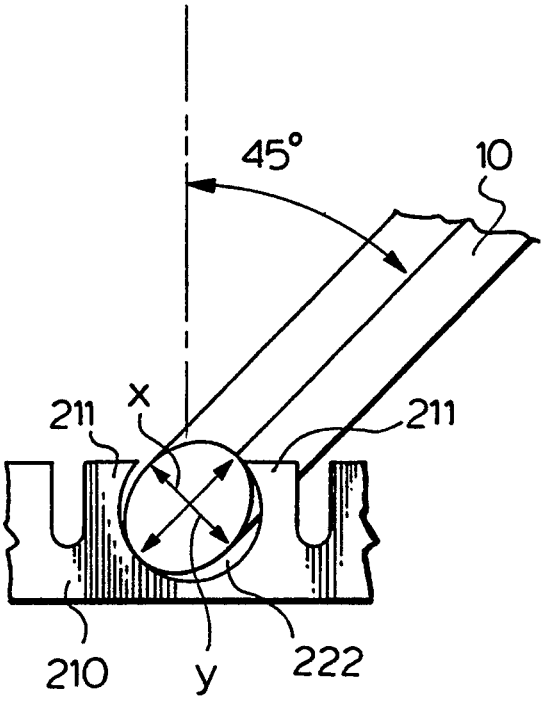

With particular reference to FIG. 4 and FIG. 5, base 210 has a multiplicity of double rows of a plurality of partially cylindrical recesses 222, in parallel, single-file arrangement. In the embodiment shown, case 200 has an array of double rows of recesses, but only one pair 224 of cooperating rows, separated by holder edge supports 225, is shown.

Each pair of elliptically-shaped members 52, 54 of holders 10 is received by recesses 222 whereby holders 10 are retained within case 200. Members 52, 54 are rotatable within recesses 222 insofar as the upper edges of recesses 222 allow. the wedge is adjacent a front portion 214*a* of top member 214, adjacent handle 208. Wedges 228 assist retention of holders 10 in recesses 222 when case 200 is in a closed position, by means of the lower surfaces 230 of wedges 228 abutting the upper surfaces of all holders 10, as holders 10 lean rearwardly, lengthwise of case 200.

Case 200 has clear window panels 232 through which holders 10 may be viewed while stored in the case.

With particular reference to FIGS. 13 and 14 hinge 206 is made up of an upper hinge member and a lower hinge member, shown generally as 240 and 242, respectively.

Upper member 240 comprises a pair of parallel, elongated arms 244 integrally formed with and downwardly extending from upper rear wall 246 of cover 214. Arms 244 terminate adjacent their lower ends 248 with an integrally formed interconnecting axle 250. Arms 244, wall 246 and axle 250 define an elongated aperture 252.

Lower hinge member 242 comprises an elongated, upstanding member 262 integrally formed and coplanar with lower rear wall 264. Member 262 on its inside face 268 has a pair of resiliently flexible protrusions 270 which define an axle receiving aperture 272. Member 262 and wall 264 define a pair of vertical open ended slots 266, which when the case is in its closed position individually receive an arm 244 such that both arms 244 flank member 262 and that aperture 272 retains axle 250 in rotatable engagement therewith.

The above hinge means provides a sturdy, convenient and practical opening/closing mechanism, which provides also an attractive appearance in that no hinge member protrudes beyond the face of the rear wall. Such an arrangement provides a security feature in that when the case is closed and locked by a handle locking means, the case cannot be opened by unlocking the hinge means.

Figure 11:
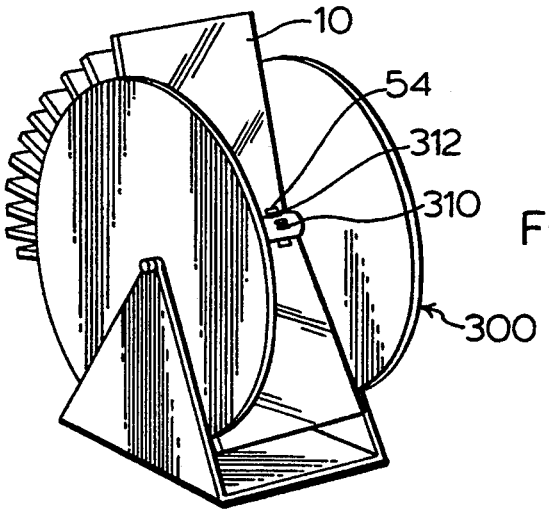
FIG. 11 is a diagramatic perspective view of an alternative case according to the invention retaining a plurality of holders.

FIG. 11 shows generally as 300, an alternative embodiment of a case, having a base 310 in the form of a cylinder, acting as an axle, upon which is retained a plurality of holders 10. The pairs of integrally-formed cylindrical members 52 (not shown), 54, disposed one from the other at the edges of holders 10, are received by the partially cylindrical recesses 312 of base 310 in a double single-file arrangement.

Figure 12:
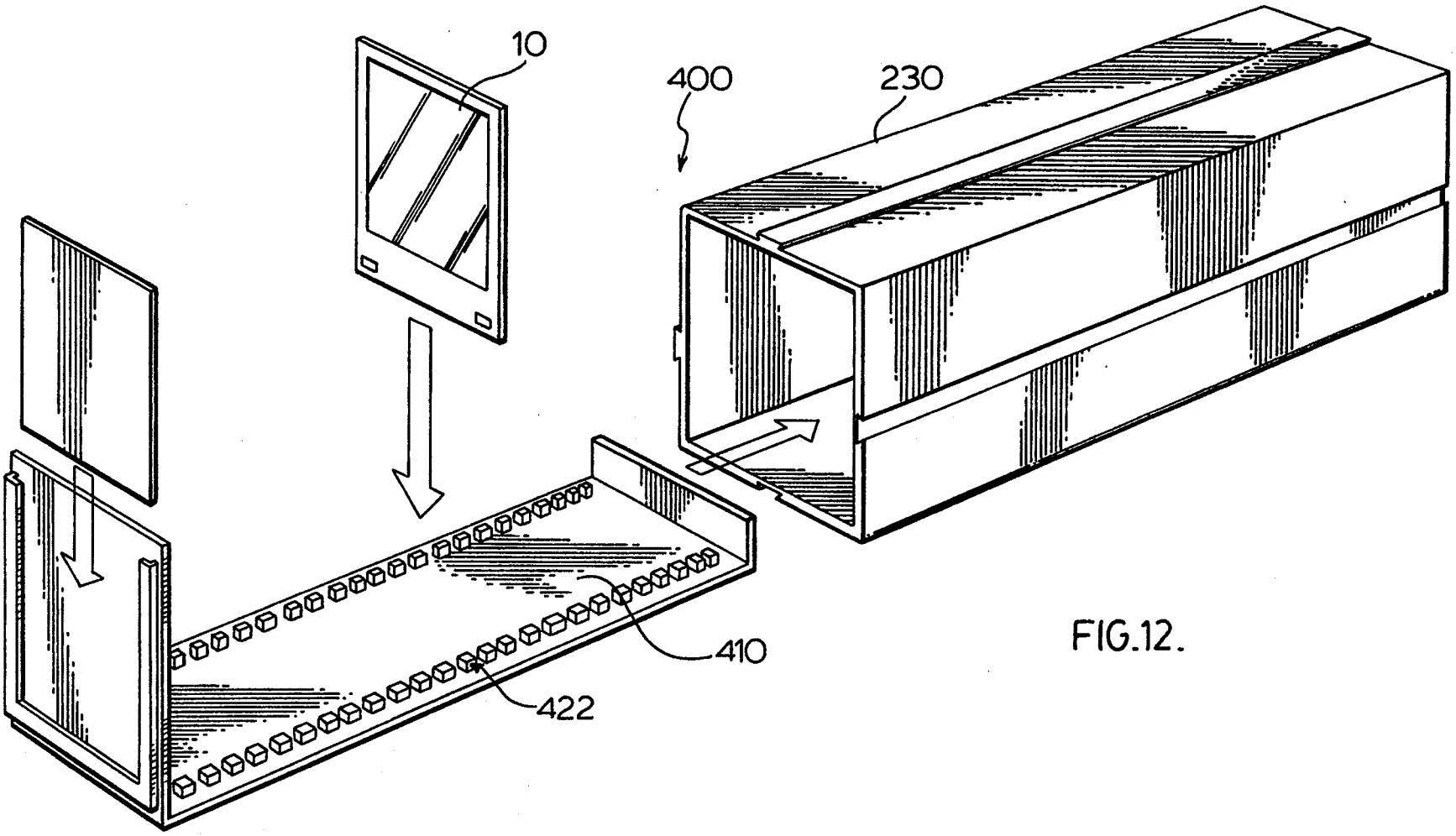
FIG. 12 is a diagramatic perspective view of an alternative embodiment of a case and a holder according to the invention.

FIG. 12 shows a yet further alternative embodiment of a case, shown generally as 400, having a base 410 with a double row of a plurality of partially cylindrical recesses 422 in single-file arrangements to receive holder 10 as part of a plurality of holders retained in a single-file arrangement. In this embodiment, the base is provided with a cover, shown generally as 230, removable from base 410.

Although this disclosure has described and illustrated certain preferred embodiments of the invention, it is to be understood that the invention is restricted to these particular embodiments. Rather, the invention includes embodiments which are functional or mechanical equivalents of the specific embodiments and features that have been described and illustrated.

The embodiments of the invention in which an exclusive property or privilege is claimed are defined as follows:

1. In combination, a plurality of planar shaped thermoplastic holders, and a case for the storage and carrying of said holders, wherein:

each holder comprises: a first planar-shaped member; a complementary opposing second planar-shaped member; and complementary snap-fit engaging means on each said first and second planar-shaped member for receiving and engaging said planar-shaped members together, an inner space being defined between said planar-shaped members adapted to retain a planar-shaped exhibit, the bottom edge of each holder including an elongate member having a substantially elliptical cross-section having a longer axis and a shorter axis, a longitudinal axis of the elliptical elongate member and the longer axis of said elliptical cross-section being coplanar the planar-shaped holder; and the case comprising:

a base having a plurality of individual holder-retaining means for releasably resiliently receiving the elliptical elongate members of a plurality of individual holders in a single-file arrangement, said retaining means comprising a plurality of elongate substantially cylindrical recesses an longitudinal axis of which is coplanar with an associated holder, the cylindrical recesses having an elongate opening subtending a radial angle of less than 90°, and the diameter of said cylindrical recess being less than the dimension of the longer axis and greater than or equal to the shorter axis of said elliptical cross-section;

whereby each holder is releasably resiliently retained in an associated recess and is confined to rotate within said associated recess a selected maximum angular deviation relative to the base.

2. A combination according to claim 1 wherein the proportional relationship of the recess diameter and longer elliptical axis provides a maximum angular deviation of 90°.

3. A case for the storage and carrying of a plurality of planar shaped thermoplastic holders, each holder comprising: a first planar-shaped member; a complementary opposing second planar-shaped member; and complementary snap-fit engaging means on each said first and second planar-shaped member for receiving and engaging said planar-shaped members together, an inner space being defined between said planar-shaped members adapted to retain a planar-shaped exhibit, the bottom edge of each holder including an elongate member having a substantially elliptical cross-section having a longer axis and a shorter axis, a longitudinal axis of the elliptical elongate member and the longer axis of said elliptical cross-section being coplanar the planar-shaped holder;

the case comprising:

a base having a plurality of individual holder-retaining means for releasably resiliently receiving the elliptical elongate members of a plurality of individual holders in a single-file arrangement, said retaining means comprising a plurality of elongate substantially cylindrical recesses a longitudinal axis of which is coplanar with an associated holder, the cylindrical recesses having an elongate opening subtending a radial angle of less than 90°, and the diameter of said cylindrical recess being less than the dimension of the longer axis and greater than or equal to the shorter axis of said elliptical cross-section.

4. A holder comprising:

a first planar-shaped member;

a complementary opposing second planar-shaped member;

complementary snap-fit engaging means on each said first and second planar-shaped member for receiving and engaging said planar-shaped members together, an inner space being defined between said planar-shaped members adapted to retain a planar-shaped exhibit; and mounting means for releasably resiliently mounting the holder in a substantially cylindrical recess of a case, a longitudinal axis of said recess being coplanar with an associated holder, the cylindrical recess having an elongate opening subtending a radial angle of less than 90°, the mounting means comprising an elongate member, on the bottom edge of the holder, having a substantially elliptical cross-section with a longer axis and a shorter axis, a longitudinal axis of the elliptical elongate member and the longer axis of said elliptical cross-section being coplanar the planar-shaped holder, the dimension of the longer axis being greater than the diameter of said cylindrical recess and the shorter axis of said elliptical cross-section being less than or equal to the diameter of said cylindrical axis."

* * * * *